United States Patent [19]

Beaver et al.

[11] 4,129,074

[45] Dec. 12, 1978

[54] MULTI-LINE IMPRINTING WHEEL APPARATUS

[75] Inventors: Millard B. Beaver; Leonard L. Johnson; Harry L. Hart; Tennis Mahoney, all of Fort Wayne, Ind.

[73] Assignee: Lincoln Logotype Co., Inc., Fort Wayne, Ind.

[21] Appl. No.: 756,398

[22] Filed: Jan. 3, 1977

[51] Int. Cl.[2] ..... B41F 17/00; B41F 13/10

[52] U.S. Cl. ..... 101/35; 101/376

[58] Field of Search ..... 101/377, 376, 375, 35, 101/328, 329, 380, 379, 381

[56] References Cited

U.S. PATENT DOCUMENTS

| | | | |
|---|---|---|---|
| 2,631,535 | 3/1953 | Mumma | 101/376 |
| 2,829,589 | 4/1958 | Alessi, Jr. et al. | 101/35 |
| 3,021,783 | 2/1962 | Casey | 101/35 |
| 3,102,468 | 9/1963 | Worth | 101/35 |
| 3,122,993 | 3/1964 | McKay | 101/35 |
| 3,327,624 | 6/1967 | Beaver | 101/35 |
| 3,467,010 | 9/1969 | King | 101/377 X |
| 3,808,970 | 5/1974 | Delligatti | 101/375 X |
| 3,968,747 | 7/1976 | Johnson | 101/376 |

*Primary Examiner*—Clifford D. Crowder
*Attorney, Agent, or Firm*—Gust, Irish, Jeffers & Rickert

[57] ABSTRACT

An imprinting wheel which comprises a plurality of annular disc members coaxial with a shaft and axially spaced therealong to define radially outwardly facing spaces therebetween and connected for rotation in unison. Printing type elements of rubber-like material have a printing portion terminating in a printing face and a base portion provided with an inner circumferential surface and joining ears which extend laterally of the printing portion. Adjacent pairs of disc members have first coaxially aligned annular shoulders forming first annular steps in the disc member which respectively engage the ears of a type element with the base portion extending across the space and the printing portion extending radially outwardly in the space and beyond the peripheral edges of the disc members, the first shoulders preventing radial outward movement of the type element. Annular resilient members have inner and outer circumferential surfaces. Each pair of adjacent disc members has second coaxially aligned annular shoulders thereon respectively forming second annular steps for engaging the opposite edges of the resilient member which has its outer surface engaging the inner surface of a type element. The unstressed outsidediameter of the resilient member is greater than the inside diameter of the second shoulders so that the resilient member is preloaded resiliently to resist radial inward movement of the type element.

19 Claims, 8 Drawing Figures

MULTI-LINE IMPRINTING WHEEL APPARATUS

BACKGROUND OF THE INVENTION

1. Field of the Invention

This invention relates generally to printing wheels carrying type on the periphery thereof for imprinting indicia on linearly moving objects such as cartons.

2. Description of the Prior Art

It is conventional practice to print indicia on cartons, boxes or containers moving along a conveyor by means of a printing wheel carrying type formed of rubber-like material of its periphery, the type-carrying periphery of the wheel being in rolling engagement with a surface of the moving object. U.S. Pat. No. 3,968,747 assigned to the assignee of the present application and U.S. Pat. Nos. 2,085,323, 2,475,524 and 3,467,010 disclose such printing wheels.

SUMMARY OF THE INVENTION

It has become standard practice for manufacturers to employ a minimum number of standardized cartons. Such standardized cartons may be preprinted with the manufacturer's logo thereon; however, it is necessary to indicate on the carton the details of the contents. It is therefore desirable to provide apparatus for imprinting indicia on such cartons before or after the cartons are filled. It is desirable that the type carried by such apparatus be readily changed, and it is further especially desirable that the apparatus accommodate cartons having irregular or deflected surfaces presented for imprinting.

The invention, in its broader aspects, provides a multiline imprinting wheel comprising a plurality of longitudinally spaced annular members coaxial with a longitudinally extending shaft, the annular members having peripheral edges and mutually defining at least two annular, radially outwardly facing openings between respective adjacent pairs of annular members. Type elements formed of rubber-like material are provided each forming a line of type and each including a base portion having opposite edges and an inner surface, and a printing portion joined to the base portion and having a printing face. Each adjacent pair of annular members has first means thereon adjacent the peripheral edges thereof for removably seating and retaining the opposite edges of the base portion of a type element, the base portion extending across the respective opening and the printing portion extending radially outwardly therein with the printing face projecting radially beyond the peripheral edges of the respective pair of annular members. Annular resilient back-up members are provided each having opposite edges, and each adjacent pair of annular members has second means thereon radially inwardly from the first means for seating and retaining the opposite edges of a resilient member, each resilient member extending across the respective opening and engaging the inner surface of the base portion of the respective type element. Each annular member is radially preloaded by the respective second seating and retaining means thereby resiliently to resist inward movement of the respective type element, each line of type thus being independently capable of limited radial and tilting movement for imprinting in parallel paths on an irregular surface.

It is an object of the invention to provide improved apparatus for imprinting indicia on linearly moving objects.

Another object of the invention is to provide an improved printing wheel.

A further object of the invention is to provide an improved multi-line imprinting wheel having two or more annularly arranged lines of type each independently capable of limited radial and tilting movement for imprinting in parallel paths on an irregular surface.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
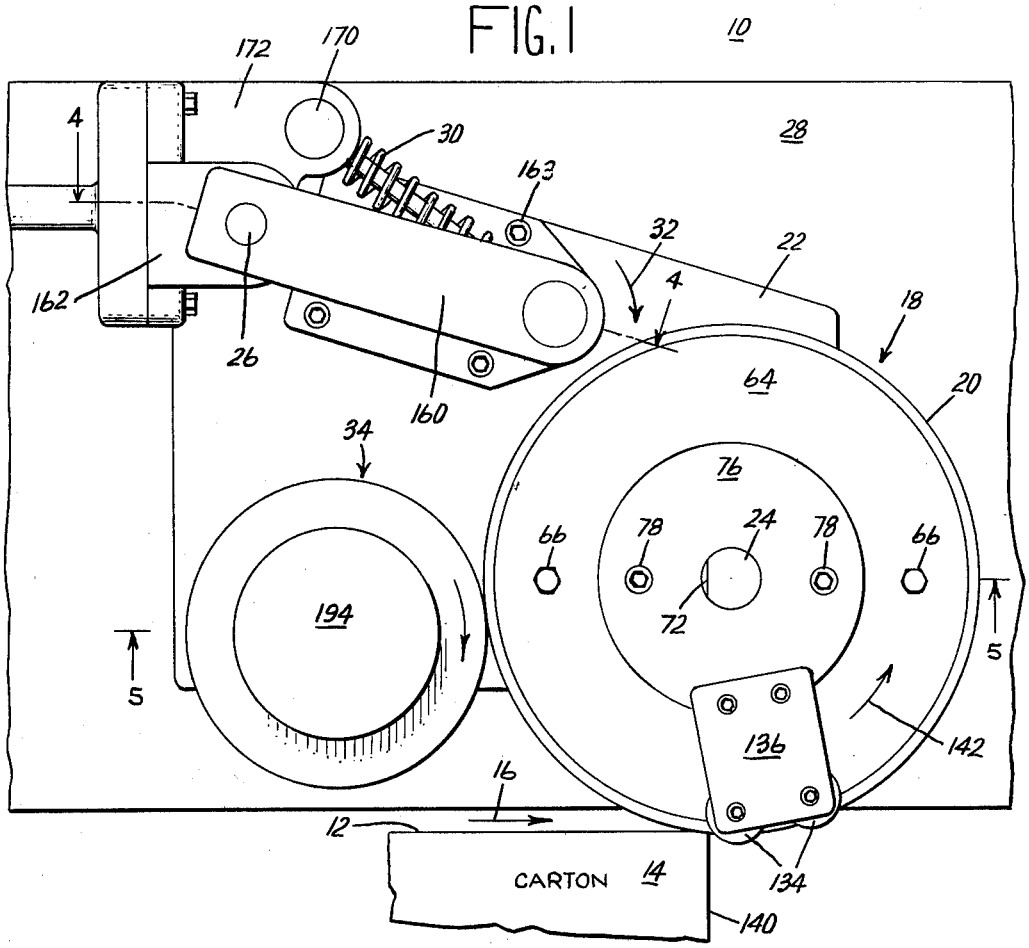
FIG. 1 is a top elevational view showing the improved imprinting apparatus of the invention.
Figure 2:
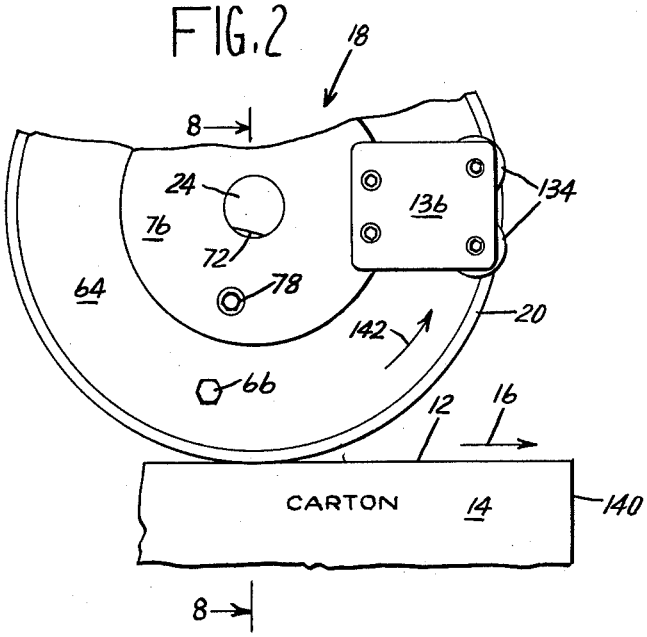
FIG. 2 is a fragmentary top plan view showing the improved printing wheel of the invention during the imprinting of a carton.
Figure 3:
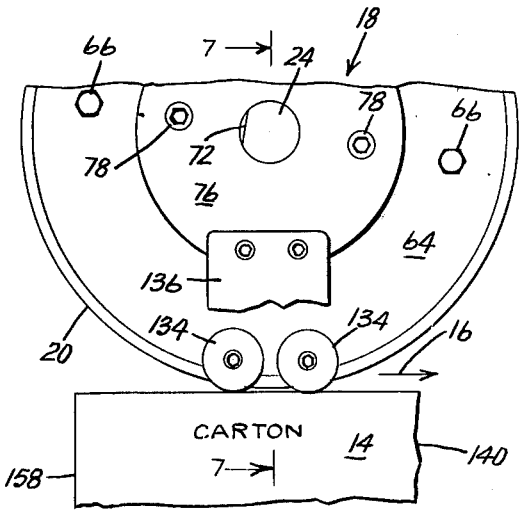
FIG. 3 is a fragmentary top plan view showing the improved printing wheel of the invention at the end of one printing revolution.

Referring now to the figures of the drawing, the improved imprinting apparatus of the invention, generally indicated at 10 (FIG. 1) is employed for imprinting indicia on surface 12 of objects, such as cardboard cartons 14, moving linearly in the direction shown by arrow 16 along a conveyor (not shown). Apparatus 10 comprises the improved printing wheel 18 of the invention having rubber-like type 20 carried on its periphery and rotatably mounted on movable plate member 22 by means of shaft 24. Plate member 22 is pivotally mounted, as at 26, on stationary frame 28. Compression spring 30 acting between stationary frame 28 and movable plate member 22 pivots movable plate member 22 in the direction shown by arrow 32 thereby to urge type 20 into rolling, printing engagement with surface 12 of carton 14 which may be irregular, both from side-to-side and end-to-end. Inking wheel 34 is rotatably carried by movable plate member 22 and engages type 20 on printing wheel 18 thereby to ink the same.

Figure 5:
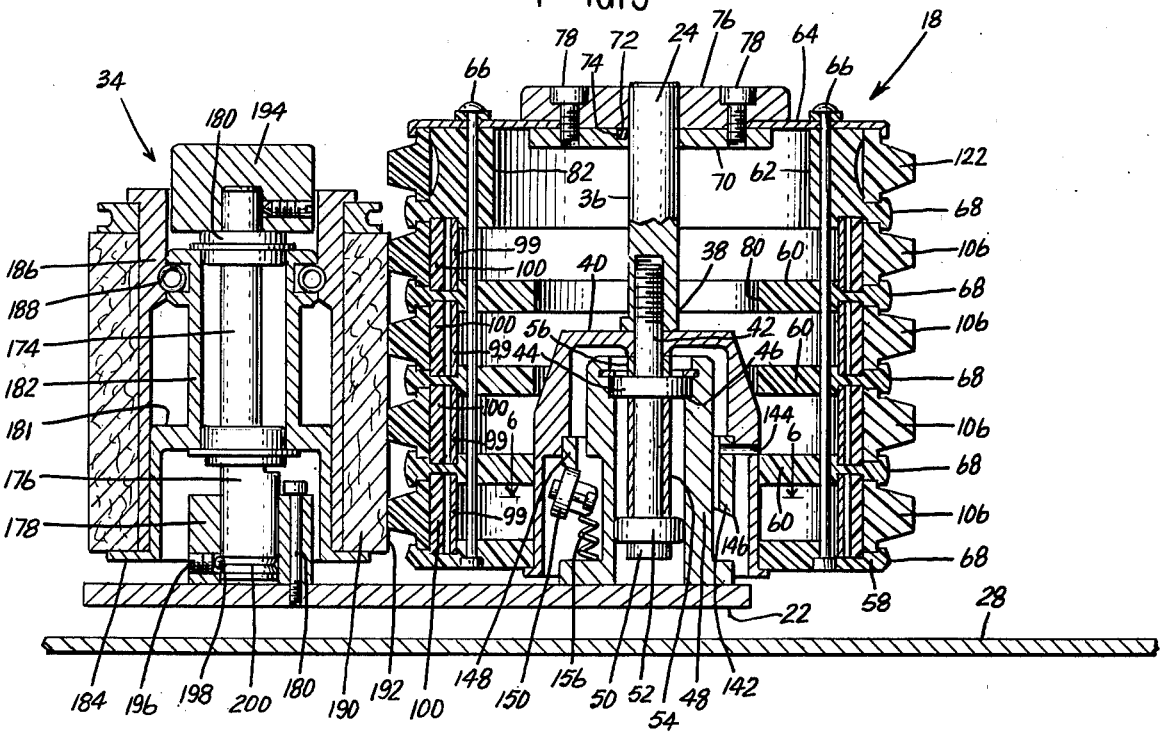
FIG. 5 is a cross-sectional view taken generally along the line 5—5 of FIG. 1.
Figure 6:
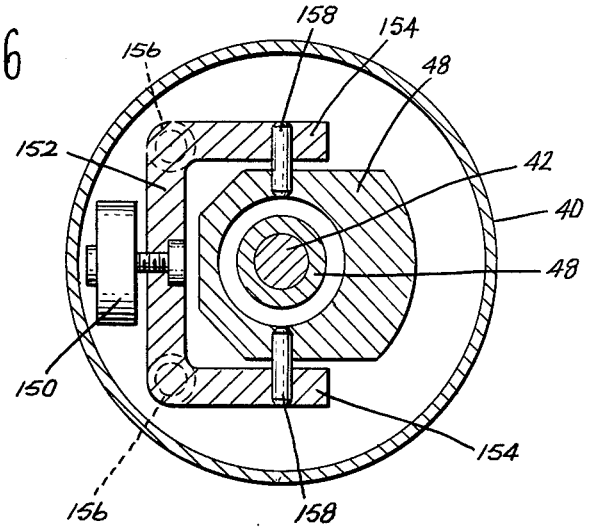
FIG. 6 is a cross-sectional view taken generally along the line 6—6 of FIG. 5.
Figure 8:
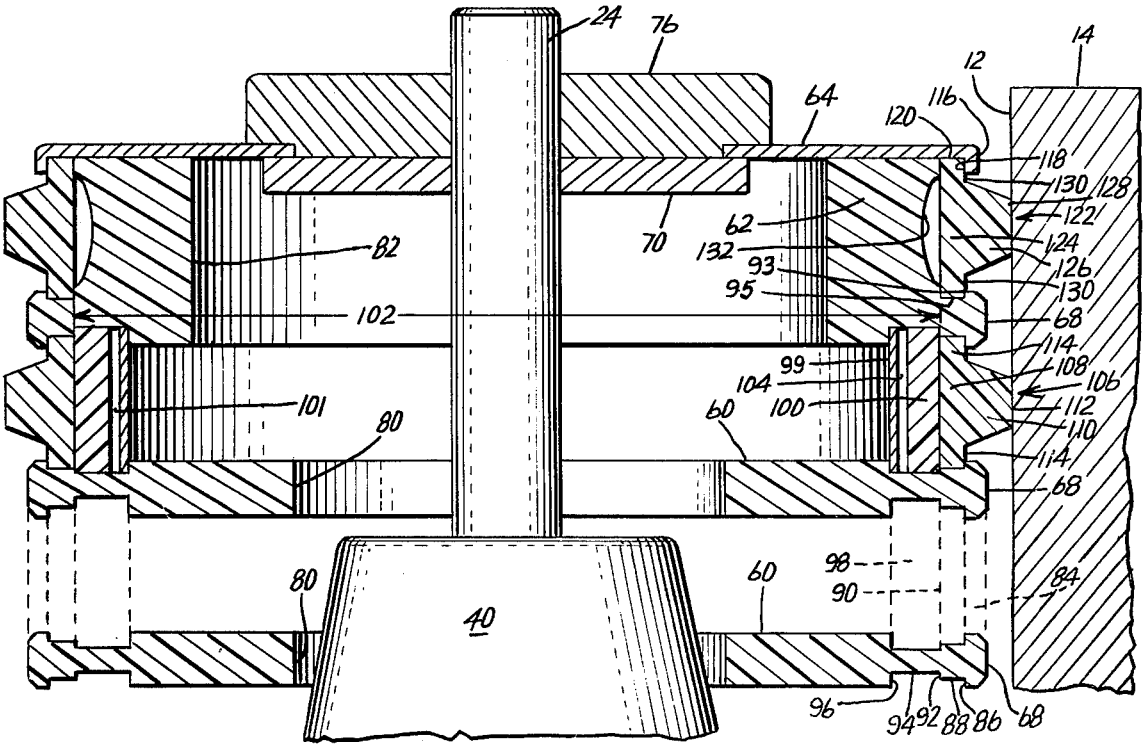
FIG. 8 is a fragmentary, enlarged cross-sectional view showing the improved printing wheel of the invention.

Referring now particularly to FIGS. 5, 6 and 8, shaft 24 of printing wheel 18, which is preferably vertically disposed, has flat 36 formed thereon. Lower end 38 of shaft 24 is secured in engagement with cup member 40 by threaded engagement with stud member 42 which extends through an opening in cup member 40 and carries bearing 44 supported on annular shoulder 46 in hub member 48 which extends upwardly from and is secured to movable plate member 22. Head 50 on stud 42 retains bearing 52, sleeve 54 on stud 42 spacing bearings 44, 52 and sleeve 56 on stud 42 spacing cup member 40 from bearing 44.

Printing wheel 18 comprises annular, end disc member 58, annular, intermediate disc members 60, annular end member 62, and annular retaining member 64, all held in assembled relation for rotation in unison by through-bolts 66. Members 58, 60 and 62 have peripheral edges 68 which define an imaginary cylinder 138 (FIG. 7) coaxial with shaft 24. Annular member 70 is secured to shaft 24 and caused to rotate therewith by means of cross-pin 72 disposed in slot 74 which engages flat 36 on shaft 24. Annular member 76 is secured to annular member 70 by threaded fasteners 78 and clamps annular member 64 thereto thus securing members 58, 60, 62 and 64 for rotation with shaft 24. Annular disc members 58, 60 have central openings 80 therein, and annular member 62 has central opening 82 therein.

As best seen in FIG. 8, each adjacent pair of disc members 58, 60, 62 defines a radially outwardly facing opening or space 84 between peripheral edges 68. Annular members 58, 60, 62 have first annular shoulders 86 spaced radially inwardly from peripheral edges 68 and first annular steps 88 extending radially inwardly from shoulders 86, first shoulders and steps 86, 88 of adjacent annular members 58, 60, 62 defining second annular openings or spaces 90 extending radially inwardly from and communicating with first openings 84, and longitudinally longer than first openings 84. Annular members 58, 60, 62 have second annular shoulders 92 spaced radially inwardly from first shoulders 86, second annular steps 94 extending radially inwardly from second shoulders 92, and third annular shoulders 96 spaced radially inwardly from second shoulders 92, second and third shoulders 92, 96 and second steps 94 of adjacent pairs of annular members 58, 60, 62 defining third annular opening or space 98 radially inwardly from second opening 90 and communicating therewith, third annular opening 98 being longitudinally longer than second annular opening 90.

Annular members 58, 60, 62 are longitudinally spaced by annular spacing members 98 which extend between adjacent pairs of annular members 58, 60 and engage third shoulders 96. In accordance with the preferred embodiment of the invention, an annular resilient member 100 formed of rubber-like material is provided extending between each adjacent pair of annular members 58, 60, 62 seated on steps 94 and retained by shoulders 92. The unstressed outside diameter of annular 100, i.e., before assembly on steps 94 of annular members 58, 60, 62, is slightly greater than the inside diameter of shoulders 92, as shown at 102 in FIG. 8. Resultantly, upon assembly of annular members 100 on steps 94, annular members 100 are preloaded, expanding radially inwardly in annular spaces 101 between spacing members 98 and annular members 100, thereby resiliently resisting radially inward force applied thereto.

Type 20 comprises elements 106 formed of suitable rubber-like material and which may be of any desired length from one character to several words, and which may encircle completely, in the form of a single strip, the wheel 18. Type elements 106 comprise base portion 108 and printing portion 110 which terminates in printing face 112. Base portion 108 has ears 114 which extend laterally from printing portion 110. Base portion 108 of each type element 106 extends between an adjacent pair of annular members 58, 60, 62 with ears 114 seated on steps 88 and retained by shoulders 86, and with printing portion 110 extending radially outwardly through opening 84 beyond peripheral edges 68 so as to be in rolling, printing engagement with surface 12 of carton 14, the inner circumferential surface of base portion 108 engaging the outer circumferential surface of the respective preloaded annular resilient member 100.

It will now be seen that the preloaded condition of annular resilient members 100 resiliently resists inward movement of type elements 106 thus permitting limited radial inward and tilting movement of elements 106. It will be seen that the combined spring forces exerted by compression spring 30 (FIG. 1), elements 106 and the preloading of annular resilient members 100 accommodates an uneven or deflected surface 12 on cartons 14 thereby to provide uniform parallel lines of printing impressions.

Annular member 64 has peripheral flange portion 116 which forms annular shoulder 118 coaxially aligned with shoulder 93 of annular member 62 and defining annular step 120 therewith in coaxial alignment with step 95. Annular friction driving member 122 is provided formed of suitable friction material, such as the same rubber-like material used for type elements 106. Driving member 122 has base portion 124 and driving portion 126 which terminates in driving face 128. Base portion 124 has ears 130 extending laterally from driving portion 126 and which engage steps 94, 120 and shoulders 92, 118. Driving portion 126 extends radially outwardly between peripheral edge 68 of member 62 and peripheral flange 116 of member 64 with driving face 128 adapted drivingly to engage surface 12 of carton 14. Thus, linear movement of carton 14 in direction 16 (FIG.1) causes surface 12 in engagement with driving member 126 to rotate printing wheel 18. Annular member 62 has a releaved portion 132 formed in its outer circumferential surface facing the inner circumferential surface 124 of driving member 122. In order to provide some lubricity to permit movement of type elements 106, annular members 58, 60, 62 are preferably machined from a plastic material sold under the tradename Delrin, but also may be formed of high-density polyethylene, nylon or material of equivalent lubricity.

Figure 7:
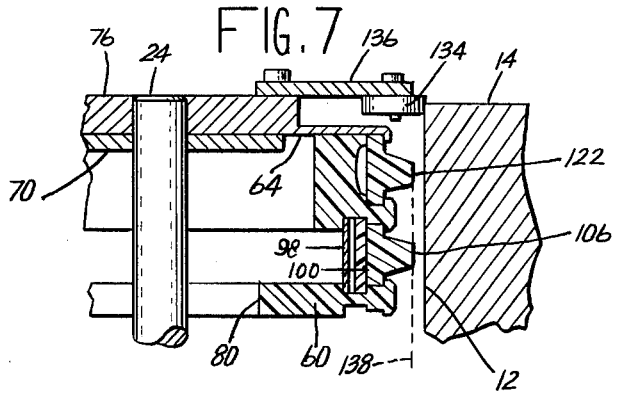
FIG. 7 is a fragmentary cross-sectional view taken generally along the line 7—7 of FIG. 3.

Referring now particularly to FIGS. 1, 2, 3 and 7, a pair of rollers 134 are rotatably mounted on bracket 136 secured to annular member 76, rollers 134 extending radially outwardly beyond the imaginary cylinder 138 defined by printing and driving faces 112, 128 of type elements 106 and driving member 126 (FIG. 7). Bracket 136 and rollers 134 are preferably positioned as shown in FIG. 1 at the beginning of a printing revolution of printing wheel 18. It will be seen that leading end 140 of carton 14 moving in direction 16 will engage rollers 134 thereby to initiate rotation of printing wheel 18 in the direction shown by arrow 142, continued rotation of printing wheel 18 in direction 142 being caused by driving engagement of driving member 122 with surface 12. When printing wheel 18 has completed substantially one complete printing revolution, and assuming the carton 14 being printed has a length greater than the circumferential dimension of printing wheel 18, rollers 134 will engage surface 12 of carton 14 thereby moving printing wheel 18, against the force exerted by compression spring 30 (FIG. 1) out of printing engagement with surface 12 of carton 14 (FIGS. 3 and 7) thereby to prevent reprinting a second time on a long carton, i.e., only one imprint is provided on such a long carton.

In order to return printing wheel 18 to an initial, reference position following one printing operation and prior to the next printing operation, an indexing mechanism is provided as best seen in FIGS. 5 and 6. Annular or barrel cam member 142 is secured to cup-shaped member 40 by pin 144, cam 142 having high portion 146 and low portion 148. Cam follower roller 150 is rotatably mounted on yoke member 152 which has it arms 154 pivotally mounted on hub 48 by pivot pins 158 (FIG. 6). Cam follower roller 150 is urged into engagement with cam 142 by compression springs 156. The rotational position of hub 48 and cam follower roller 150 is suitably adjusted so that cam follower roller 150 is in engagement with low portion 148 of cam 142 at the desired initial position of printing wheel 18, such as that shown in FIG. 1. It will now be seen that when printing wheel 18 is rotated away from the initial, reference position, the cooperative engagement of cam follower 150 with cam 142 under the influence of springs 156 tends to return printing wheel 118 to its initial position. Thus, when trailing edge 158 of carton 14 passes out from under rollers 134, the indexing mechanism above-described will return printing wheel 18 in direction 142 to its initial position, as shown in FIG. 1, in readiness for imprinting the next carton.

Figure 4:
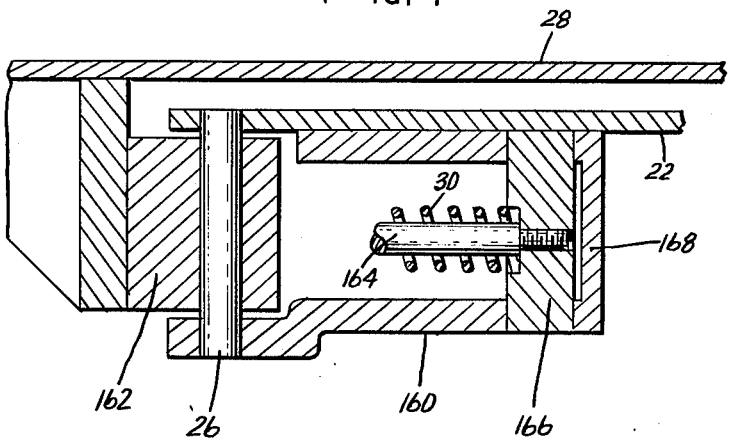
FIG. 4 is a fragmentary cross-sectional view taken generally along the line 4—4 of FIG. 1.

Referring now briefly to FIGS. 1 and 4, bracket 160 is secured to movable plate member 22, as by threaded fasteners 163, and is pivotally connected to boss 162 mounted on stationary frame 28 by pivot pin 26, which also pivotally mounts movable plate member 22. Compression spring 30 surrounds pin 164 secured to pin 166 pivotally mounted in end 168 of bracket 160 and engages pin 170 in boss 172 mounted on stationary frame member 28. It will now be seen that movable plate member 22 is thus pivotally mounted by pin 26 for pivotal movement in direction 32 under the urging of compression spring 30.

It will now be seen that type elements 106 may be loaded on printing wheel 18 at any circumferential position thereon by merely forcing base portion 108 radially inwardly into the respective opening 90 into engagement with the respective shoulders 86, steps 88 and the respective annular resilient members 100. Thus, it is not necessary to insert type segments sequentially into slots through a single opening communicating therewith, as in the case of certain prior printing wheel constructions such as shown in U.S. Pat. No. 3,968,747. It will further be seen that following assembly of the desired type elements 106 on printing wheel 18, the wheel may be adjusted to provide the desired location of the printed indicia on surface 12 of carton 14 by merely loosening threaded fasteners 78 and rotating annular members 58, 60, 62, 64 with respect to annular members 70, 76 to the desired rotational position, threaded fasteners 78 thereafter being again tightened so that annular member 64 is firmly clamped between annular members 70, 76.

Referring now particularly to FIGS. 1 and 5, inking mechanism 34 comprises shaft 174 having eccentric extension portion 176 mounted in hub 178 secured to movable plate member 22, as by threaded fasteners 180. Shaft 174 has bearings 181 thereon which rotatably support sleeve 182 having lower outwardly extending flange 184. Sleeve 186 is removably positioned on sleeve 182 and is removably retained thereon by garter spring 188. Cylinderical inking pad 190 formed of suitable ink retaining material, such as that sold by S. C. Johnson and Company under the trademark Porelon, is mounted on sleeve 186. Shaft 174 is adjusted by means of adjusting knob 194 secured to shaft 174 so that circumferential surface 192 of inking pad 190 applies sufficient inking force on printing faces 112 of type elements 106. Set screw 196 cooperating with nylon ball 198 in groove 200 of eccentric portion 176 of shaft 174 locks eccentric 176 in the position determined by adjustment of knob 194. Sleeve 186 with inking member 190 thereon may be readily removed from sleeve 182 thereby to reink inking member 190.

It will now be seen that preloaded annular members 100 urge type elements 106 radially outwardly against shoulders 86, annular resilient members 100 yielding radially inwardly to permit insertion of type elements anywhere around the periphery of printing wheel 18; annular resilient members 100 are permitted to flex or deform into annular space 101 defined between spacers 99 and inner circumferential surface 104 of annular members 100 to accommodate insertion of type elements 106 and also irregularities in surface 12 of carton 14. Because of the resilience and the inward flexure or deformation into space 101, each resilient or back-up ring 100 inherently can bodily flex or deform radially inwardly or one edge portion can move radially inwardly in a tilting direction to accommodate similar movement of the respective type element 106. It will further be seen that the number of sections of printing wheel 18, each section being defined by an adjacent pair of annular members 58, 60, 62, may be reduced by simply removing through bolts 66, and then removing one or more annular disc members 60. It will additionally be seen that with the vertically disposed arrangement of shaft 24 shown, gravity alone is relied upon for retaining printing wheel 18 in operative position on shaft 24 and thus, a given printing wheel 18 may readily be removed by merely lifting the same upwardly off of shaft 24, and another printing wheel 18 having different type segments 106 thereon assembled on shaft 24. It will still further be seen that the entire printing wheel 18 may be rotationally adjusted relative to the initial or reference position determined by the indexing mechanism.

While annular, resilient back-up members 100 are described above as being formed of rubber-like material, they may comprise resilient members or devices of other material or design. For example, a relatively thin, annular metallic band of spring steel or the like, at least partially coiled upon itself in the manner of a clock spring, and capable of resiliently inward flexure, may be used. Such a device, provided it has a soft springiness resembling that of the rubber-like ring 100, will flex resiliently inward under the compressive force exerted by type elements 106 during printing. Alternatively, resilient back-up members 100 may be formed of resilient plastic foam, such as polyurethane, which fills the spaces between spacer members 98 and shoulders 92, the foam rings having essentially the same resilient characteristics as the rubber-like rings 100 to permit type segments to depress or tilt in response to irregular printing surfaces. It is thus within the scope of this invention to employ any resilient back-up member or device which provides the resilient characteristics of rubber-like ring 100, which flexes or deforms radially and axially, and which thus permits limited radial and/or tilting movement of the type elements, the rubber-like ring 100 being preferred.

It will now be understood that in an imprinting operation in which it is desired simultaneously to imprint two or more lines, frequently the surfaces upon which the lines are to be imprinted vary irregularly in height and angle with respect to each other. It will be seen that by reason of the resiliently flexible backing, each line of type will conform to the irregularities, adjusting independently of the other lines to provide clear, substantially uniform, parallel imprints; if the surface to be imprinted with one line is higher than that to be imprinted with an adjacent line, or at an angle thereto, the type engaging that surface will move radially inwardly, or tilt slightly, thus permitting the adjacent line of type properly to engage the adjacent lower or angled surface. By proper selection of the degree of flexibility of resilient backing members 100, clear, multi-line imprints may be obtained which are substantially uniform as to density and clarity of the imprinted indicia for surface irregularities which do not exceed the limitations of the apparatus. The imprinted indicia may take the form of spaced letters, numbers and/or symbols arranged in straight, substantially parallel lines.

While there have been described above the principles of this invention in connection with specific apparatus, it is to be clearly understood that this description is made only by way of example and not as a limitation to the scope of the invention.

What is claimed is:

1. A multi-line imprinting wheel comprising: a plurality of longitudinally spaced annular members coaxial with a longitudinally extending shaft, said annular members having peripheral edges and defining at least two annular, radially outwardly facing openings between adjacent pairs thereof; a plurality of type elements formed of rubber-like material each forming a line of type, each said type element including a base portion having opposite edges and an inner surface, and a printing portion joined to said base portion and having a printing face; each said adjacent pair of annular members having first means thereon for removably seating and retaining said opposite edges of said base portion of a said type element with said base portion thereof extending across the respective opening and said printing portion extending radially outwardly therein and with said printing face projecting radially beyond the peripheral edges of the respective pair of annular members; a plurality of annular resilient back-up members each having axially spaced opposite edges and an outer surface, each back-up member being in the form of a single, solid element of resilient material; each said adjacent pair of annular members having second means thereon in the form of facing radial surfaces and annular shoulders radially inwardly from said first means which are abuttable with the opposite edges and portions of the outer surface of a said resilient member for seating the latter with said resilient member extending across the respective opening and with its remaining portion of said outer surface engaging said inner surface of the respective type element; each said resilient member being resiliently radially movable inwardly with said outer surface thereof engaged with said inner surface of said type element being capable of both radial and tilting movement, each said resilient member resiliently resisting inward and tilting movement of the respective type element whereby each line of type is independently capable of limited radial and tilting movement for imprinting in parallel paths on an irregular surface.

2. The imprinting wheel of claim 1 further comprising: an annular driving member formed of friction material and having an outside diameter substantially equal to that defined by said printing faces of said type elements; and means for mounting said driving member on said wheel for rotation therewith, said driving member being adapted drivingly to engage the surface to be imprinted of a moving object thereby to rotate said wheel.

3. The imprinting wheel of claim 2 wherein said mounting means is a longitudinally endmost one of said plurality of annular members.

4. The imprinting wheel of claim 3 further comprising a first mounting member secured to said shaft for rotation therewith; a second mounting member; and adjustable means for securing said second mounting member to said first mounting member at selected radial positions with respect thereto and for securing said annular members to said shaft for rotation therewith.

5. The imprinting wheel of claim 1 further comprising means mounted on said wheel for rotation therewith for moving said printing faces of said type elements out of printing engagement with a surface previously imprinted after a predetermined printing rotation of said wheel.

6. The imprinting wheel of claim 5 wherein said moving means comprises means for engaging said surface responsive to said predetermined printing rotation, said engaging means projecting radially outwardly beyond said printing faces of said type elements thereby moving said wheel outwardly away from said surface.

7. The imprinting wheel of claim 6 wherein said engaging means comprises at least one roller.

8. The imprinting wheel of claim 6 further comprising means for rotating said wheel to a reference position of said moving means responsive to disengagement of said engaging means from said surface, said predetermined rotation being from said reference position.

9. The imprinting wheel of claim 8 further comprising means for rotatably supporting said shaft; means for securing said wheel to said shaft for rotation therewith; said rotating means comprising a cam on one of said shaft and shaft supporting means, a cooperating cam follower on the other of said shaft and shaft supporting means, and resilient means for biasing said cam follower into engagement with said cam, said cam being proportioned and arranged so that said cam follower under the influence of said resilient means returns said cam, shaft and wheel to said reference position.

10. The imprinting wheel of claim 9 wherein said securing means includes means for selectively adjusting the rotational position of said wheel with respect to said shaft.

11. The imprinting wheel of claim 10 wherein said moving means in said reference position is adapted to be engaged by the leading end of a moving object having said surface thereon at the beginning of a printing rotation of said wheel, said predetermined printing rotation being substantially one revolution of said wheel.

12. The imprinting wheel of claim 1 further comprising: a stationary frame member; a movable member pivotally mounted on said frame member and having said shaft mounted thereon; and resilient means acting between said frame member and movable member for biasing the same in a direction to urge said wheel into engagement with a surface to be imprinted.

13. The imprinting wheel of claim 1 wherein said resilient members are cylindrically shaped and formed of rubber-like material.

14. A multi-line imprinting wheel comprising: a plurality of longitudinally spaced annular members coaxial with a longitudinally extending shaft, said annular members having peripheral edges and defining at least two annular, radially outwardly facing openings between adjacent pairs thereof; a plurality of type elements formed of rubber-like material each forming a line of type, each said type element including a base portion having opposite edges and an inner surface and a printing portion joined to said base portion and having a printing face; each said adjacent pair of annular members having first means thereon for removably seating and retaining said opposite edges of said base portion of a said type element with said base portion thereof extending across the respective opening and said printing portion extending radially outwardly therein and with said printing face projecting radially beyond the peripheral edges of the respective pair of annular members; a plurality of annular resilient back-up members each having axially spaced opposite edges and an outer surface; each said adjacent pair of annular members having second means thereon radially inwardly from said first means for seating and retaining the opposite edges of a said resilient member with said resilient member extending across the respective opening and with its said outer surface engaging said inner surface of the respective type element; each said resilient member being resiliently radially movable inwardly with said outer surface thereof being capable of both radial and tilting movement, each said resilient member resiliently resisting inward and tilting movement of the respective type element whereby each line of type is independently capable of limited radial and tilting movement for imprinting in parallel paths on an irregular surface, a plurality of annular spacing members each having opposite edges and an outer surface; each said resilient member having an inner surface, each said pair of annular members having third means thereon for seating and retaining a respective spacing member with said spacing member extending across said opening and with its said outer surface normally spaced radially inwardly from said inner surface of the respective resilient member.

15. A multi-line imprinting wheel comprising: a plurality of longitudinally spaced annular members coaxial with a longitudinally extending shaft, said annular members having peripheral edges and defining at least two annular, radially outwardly facing openings between adjacent pairs thereof; a plurality of type elements formed of rubber-like material each forming a line of type, each said type element including a base portion having opposite edges and an inner surface, and a printing portion joined to said base portion and having a printing face; each said adjacent pair of annular members having first means thereon for removably seating and retaining said opposite edges of said base portion of a said type element with said base portion thereof extending across the respective opening and said printing portion extending radially outwardly therein and with said printing face projecting radially beyond the peripheral edges of the respective pair of annular members; a plurality of annular resilient back-up members each having axially spaced opposite edges and an outer surface; each said adjacent pair of annular members having second means thereon radially inwardly from said first means for seating and retaining the opposite edges of a said resilient member with said resilient member extending across the respective opening and with its said outer surface engaging said inner surface of the respective type element; each said resilient member being capable of both radial and tilting movement, each said resilient member resiliently resisting inward and tilting movement of the respective type element whereby each line of type is independently capable of limited radial and tilting movement for imprinting in parallel paths on an irregular surface, said first means comprising first, annular, radially inwardly facing, coaxially aligned shoulders respectively joined to first annular steps extending radially inwardly from said first shoulders; said second means comprising second, annular, radially inwardly facing, coaxially aligned shoulders respectively joined to said first steps, said second shoulders being respectively joined to second annular steps extending radially inwardly from said second shoulders; said peripheral edges of each said pair of annular members mutually defining a first section of the respective opening, said first steps of each said pair of annular members mutually defining a second section of the respective opening longitudinally longer than the respective first section, said second steps of each said pair of annular members mutually defining a third section of said opening longitudinally longer than the respective second section.

16. The imprinting wheel of claim 15 wherein said resilient members are formed of rubber-like material, the unstressed outside diameter of each said resilient member being greater than the inside diameter of the respective second shoulders thereby preloading said resilient members.

17. The imprinting wheel of claim 16 wherein said annular members have third, annular, radially outwardly facing, coaxially aligned shoulders formed thereon respectively joined to said second steps; and further comprising a plurality of annular spacing members each having an outer surface; each said spacing member engaging said third shoulders of a respective pair of annular members and extending across the respective third opening section; each said resilient member having an inner surface normally radially spaced from said outer surface of a respective spacing member.

18. An imprinting wheel comprising: a plurality of annular members coaxially disposed on an axis; means for axially spacing said annular members thereby to define radially outwardly facing spaces therebetween; means for connecting said annular members for rotation in unison about said axis; said annular members having peripheral edges defining an imaginary cylinder coaxial with said axis; at least one type element formed of rubber-like material; said element comprising a printing portion terminating in a printing face and a base portion joined to said printing portion and having an inner circumferential surface joining ears extending laterally on opposite sides of said printing portion, at least a pair of adjacent annular members having first means for respectively receiving said ears with said base portion extending across said space and said printing portion extending radially outwardly in said space and beyond said cylinder, said first means including means for preventing radial outward movement of said type element; and an annular resilient back-up member having inner and outer circumferential surfaces joining axially opposite radial edges; said back-up members being cylindrically shaped and coaxial with said annular members to extend therebetween, each pair of said annular members having facing radial surfaces abuttable with the opposite edges of said back-up member to retain the latter against axial displacement, each pair of annular members further having axially extending inwardly projecting coaxial annular shoulders against which portions of the outer surface of the back-up member engages thereby to retain the latter in coaxial position, said type element base portion engaging the remaining portion of the outer surface of said back-up member, said back-up member being resiliently radially movable inwardly with said outer surface thereof being capable of both radial and tilting movement, said resilient member resiliently resisting inward and tilting movement of said type segment.

19. The imprinting wheel of claim 18 wherein said spacing means comprises an annular spacing member having an outer circumferential surface joined to opposite radial edges, said second means receiving said last-named opposite edges with said spacing member extending across said space and having its outer surface normally spaced radially inwardly from said inner surface of said resilient member.

* * * * *

UNITED STATES PATENT AND TRADEMARK OFFICE

CERTIFICATE OF CORRECTION

PATENT NO. : 4,129,074

DATED : December 12, 1978

INVENTOR(S) : Millard B. Beaver et al.

It is certified that error appears in the above-identified patent and that said Letters Patent are hereby corrected as shown below:

Column 1, line 13, "of" should be -- on --.

Column 3, line 39, "98" should be -- 99 --.

Column 9, line 61, after "being" insert -- resiliently radially movable with said outer surface thereof --.

Signed and Sealed this

*First* Day of *May 1979*

[SEAL]

*Attest:*

RUTH C. MASON
*Attesting Officer*

DONALD W. BANNER
*Commissioner of Patents and Trademarks*